US007586054B2

(12) United States Patent
Jin

(10) Patent No.: US 7,586,054 B2
(45) Date of Patent: Sep. 8, 2009

(54) SWITCH ASSEMBLY

(75) Inventor: Seong-ki Jin, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 747 days.

(21) Appl. No.: 10/899,114

(22) Filed: Jul. 27, 2004

(65) Prior Publication Data

US 2005/0023121 A1 Feb. 3, 2005

(30) Foreign Application Priority Data

Jul. 29, 2003 (KR) ..... 10-2003-0052432

(51) Int. Cl.
*H01H 19/00* (2006.01)

(52) U.S. Cl. ..... 200/336; 200/296; 200/293; 200/345

(58) Field of Classification Search ..... 200/293, 200/296, 336, 344, 345, 332, 11 R, 11 TW, 200/335, 564–567
See application file for complete search history.

(56) References Cited

U.S. PATENT DOCUMENTS

| | | | | |
|---|---|---|---|---|
| 3,718,786 | A * | 2/1973 | Fila | 200/419 |
| 3,797,907 | A * | 3/1974 | Leith | 359/30 |
| 4,857,677 | A * | 8/1989 | Tanaka et al. | 200/5 R |
| 5,180,050 | A * | 1/1993 | Rada et al. | 200/329 |
| 5,227,595 | A * | 7/1993 | Sorenson et al. | 200/11 J |
| 5,589,671 | A * | 12/1996 | Hackbarth et al. | 200/6 R |
| 5,621,196 | A * | 4/1997 | Nishijima et al. | 200/6 A |
| 6,049,048 | A * | 4/2000 | Ohira | 200/339 |
| 6,079,401 | A * | 6/2000 | Alvord et al. | 126/39 G |
| 6,096,985 | A * | 8/2000 | Ritter et al. | 200/6 A |
| 6,339,200 | B1 * | 1/2002 | Shi et al. | 200/305 |
| 6,512,189 | B1 * | 1/2003 | Schuberth et al. | 200/334 |
| 6,525,281 | B2 * | 2/2003 | Quapil | 200/43.01 |
| 6,621,016 | B2 * | 9/2003 | Ohba et al. | 200/4 |
| 6,713,701 | B2 * | 3/2004 | Miyako et al. | 200/517 |
| 6,797,907 | B1 * | 9/2004 | Meagher et al. | 200/564 |
| 6,812,415 | B1 * | 11/2004 | Priesemuth | 200/5 R |

FOREIGN PATENT DOCUMENTS

| | | |
|---|---|---|
| DE | 195 32 822 | 3/1997 |
| JP | 05-074277 | 3/1993 |
| JP | 08-064079 | 3/1996 |

(Continued)

*Primary Examiner*—Kyung Lee
(74) *Attorney, Agent, or Firm*—Roylance, Abrams, Berdo & Goodman, LLP

(57) ABSTRACT

A switch assembly comprises first and second tact switches located on a printed circuit board (PCB) at a predetermined interval, a shuttle body having a pair of tension ribs, including a first tension rib and a second tension rib located in parallel with each other, to turn on/off the first and the second tact switches, and a knob holding shaft provided between the first and the second tension ribs, a manipulation knob connected to the knob holding shaft of the shuttle body, rotating between a position where the manipulation knob presses one of the first and the second tension ribs to operate the corresponding tact switch and a position where the manipulation knob releases the tension rib, and a spring member connected with the knob holding shaft of the shuttle body elastically pressing the manipulation knob to the releasing position.

9 Claims, 6 Drawing Sheets

FOREIGN PATENT DOCUMENTS

| | | |
|---|---|---|
| JP | 2000-149713 | 5/2000 |
| JP | 2001-243759 | 9/2001 |
| JP | 2001-250453 | 9/2001 |
| JP | 2002-091170 | 3/2002 |
| JP | 2002-133967 | 5/2002 |
| JP | 2002-270065 | 9/2002 |
| KR | 20-0135187 | 10/1998 |
| KR | 20-0155303 | 5/1999 |
| KR | 20-0230688 | 5/2001 |
| KR | 20-0298262 | 12/2002 |
| WO | WO 93/23862 | 11/1993 |

* cited by examiner

SWITCH ASSEMBLY

CROSS-REFERENCE TO RELATED APPLICATIONS

This application claims the benefit under 35 U.S.C. §119 (a) of Korean Patent Application No. 2003-52432, filed on Jul. 29, 2003, in the Korean Intellectual Property Office, the disclosure of which is incorporated herein by reference in its entirety.

BACKGROUND OF THE INVENTION

1. Field of the Invention

The present invention relates to a switch assembly. More particularly, the present invention relates to a switch assembly having a shuttle function and a button function in an integrated form.

2. Description of the Related Art

An electronic product, such as a video cassette tape recorder (VCR), a video tape recorder (VTR), or a digital video disk player (DVDP), is provided with a plurality of manipulation knobs to manipulate functions of the electronic product. The manipulation knobs are for various operations of, for example, playing, fast-forwarding, re-winding, pausing and stopping, according to the on/off state of the switches installed on a printed circuit board (PCB). However, because there are so many different manipulation knobs, the size of the product must be oversized. Recently, an integrated switch assembly has been developed to solve the problem by selectively manipulating a plurality of functions.

FIG. 1 is a cross section view showing a conventional switch assembly, and FIG. 2 is an exploded perspective view of FIG. 1. As shown in FIGS. 1 and 2, a conventional switch assembly 100 includes a shuttle unit 120 and a plurality of tact switches 131 and 132 disposed on a printed circuit board (PCB) 110, a shuttle knob 140 operating the shuttle unit 120, and a button knob 150 for turning on/off the tact switches 131 and 132. The conventional switch assembly 100 further includes a board holder 160 and a button knob holder 170 interposed between the tact switches 131 and 132 and the button knob 150.

The plurality of tact switches 131 and 132 are arranged in a radial direction with respect to the shuttle unit 120 rotatably disposed on the PCB 110. The plurality of tact switches 131 and 132 are located at predetermined intervals and signals the performance of different functions, namely, playing, stopping, pausing, or inserting/ejecting. The board holder 160, located on the front surface of the PCB 110, where the tact switches 131 and 132 are located, compensates for a stepped width between the tact switches 131 and 132 and the PCB 110.

When assembled with the button knob holder 170, the button knob 150 is connected to the front surface of the PCB 110 where the board holder 160 is disposed. The button knob holder 170 is provided with a plurality of poles 171 and 172 protruding therefrom and corresponding to the tact switches 131 and 132 fixed to the PCB 110. As a side of the button knob 150 is pressed, the poles 171 and 172 of the button knob holder 170 turn on/off the corresponding tact switches 131 and 132. The shuttle knob 140 is connected to the shuttle unit 120 to rotate 360° in either a clockwise direction or a counter-clockwise direction. The button knob 150 includes a plurality of tension ribs 155 spaced from the shuttle knob 140 by a predetermined distance. For example, a user can adjust the volume of sound by rotating the shuttle knob 140.

However, the conventional switch assembly 100 has a complicated construction requiring assembly of the shuttle knob 140, the button knob 150, the button knob holder 170, and the board holder 160 with the shuttle unit 120. Therefore it is difficult to disassemble the switch assembly 100, which increases manufacturing costs. Particularly, since the shuttle unit 120 is a single unit integrating a plurality of components therein, it has to be manufactured as an original equipment manufacturer (OEM) part, resulting in increased manufacturing costs.

Also, if a malfunction occurs in the relatively expensive shuttle unit 120, the entire switch assembly 100 has to be replaced causing increased maintenance costs.

SUMMARY OF THE INVENTION

The present invention has been developed in order to solve the above problems in the related art. Accordingly, it is an aspect of the present invention to provide a switch assembly having a simplified construction capable of facilitating assembling/disassembling and, particularly, reducing manufacturing and maintenance costs.

Another aspect of the present invention is to provide a switch assembly with a compact design to reduce the size of a product.

Still another aspect of the present invention is to provide a switch assembly that makes operating an electronic product more convenient for a user.

The above aspects are achieved by providing a switch assembly comprising first and second tact switches disposed on a printed circuit board (PCB) at a predetermined interval. The switch assembly comprises a shuttle body having a pair of tension ribs including a first tension rib and a second tension rib located in parallel to each other, to turn on/off the first and the second tact switches; and a knob holding shaft between the first and the second tension ribs; a manipulation knob connected to the knob holding shaft of the shuttle body, rotating between a position where the manipulation knob presses one of the first and the second tension ribs to operate the corresponding tact switch and a position where the manipulation knob releases the tension rib. The switch assembly further includes a spring member connected to the knob holding shaft of the shuttle body to elastically press the manipulation knob to the releasing position.

The manipulation knob may comprise a pair of operating portions outwardly protruding from the manipulation knob in a radial direction, having a predetermined angle between each operating portion, and operating with the first and the second tension ribs of the shuttle body, and a connection portion extending from the manipulation knob in an axial direction and connected to the shuttle body.

In other embodiments, the first and the second tension ribs of the shuttle body each may comprise a protrusion upwardly protruding toward the manipulation knob, and an inclined portion formed at a predetermined inclination angle with respect to the protrusion and inwardly curved, contacting the operating portion of the manipulation knob.

In other embodiments, the shuttle body may have a guide hole or recess formed therein, to receive the connection portion of the manipulation knob and restrict the movements of the connection portion within a predetermined range.

In other embodiments, the operating portions of the manipulation knob each may include a pair of locking protrusions locked by opposite ends of the spring member, which exerts an elastic biasing force toward the releasing position.

In other embodiments, a third tact switch may be further disposed on the PCB, and the shuttle body further includes a third tension rib interposed between the first and the second tension rib to operate with the third tact switch, and the third tension rib is elastically deformed when pressed by the manipulation knob positioned at the release position, thereby turning on the third tact switch.

In other embodiments, the shuttle body may be provided with an elastic supporting rib which elastically supports the manipulation knob such that the third tension rib is placed at a position to turn off the third tact switch.

In other embodiments, the switch assembly may further comprise a shuttle ring interposed between the manipulation knob and a front panel of an electronic product which exposes a part of the manipulation knob to the outside.

In a preferred embodiment, the switch assembly further comprises a shuttle ring interposed between the manipulation knob and a front panel of an electronic product which exposes a part of the manipulation knob to the exterior of the electronic product.

The above aspects and other advantages are achieved by providing a switch assembly comprising a manipulation knob, and a shuttle body integrally formed with a knob holding shaft to which the manipulation knob is rotatably connected, and a plurality of tension ribs positioned within a rotating radius of the manipulation knob to be selectively deformed by the manipulation knob.

Furthermore, the switch assembly may further comprise a spring member connected to the knob holding shaft to return the manipulation knob to an original position.

In addition, the switch assembly may further comprise a plurality of tact switches fixed onto a printed circuit board (PCB) to be turned on/off by the plurality of tension ribs.

Finally, the shuttle body may be formed by injection molding.

BRIEF DESCRIPTION OF THE DRAWING FIGURES

The above aspects and other advantages of the present invention will be more readily understood in connection with the following description of an exemplary embodiment of the present invention with reference to the accompanying drawings, in which.

In the drawing figures, it will be understood that like reference numerals refer to like features and structures.

DETAILED DESCRIPTION OF THE EXEMPLARY EMBODIMENT

Hereinafter, a switch assembly according to an exemplary embodiment of the present invention will be described in greater detail.

Figure 1:
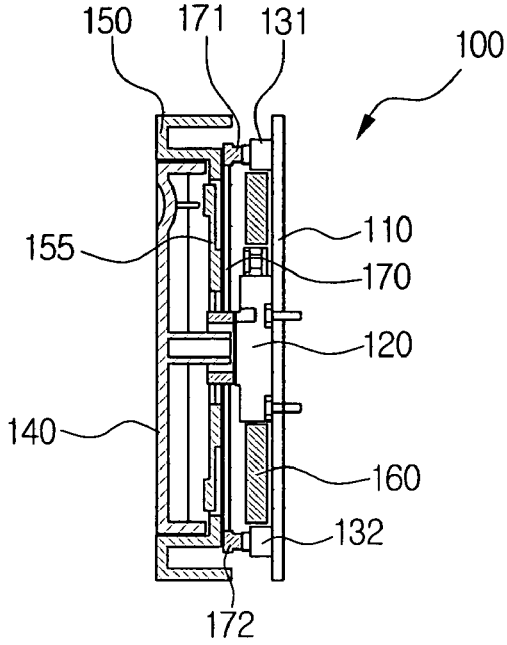
FIG. 1 (PRIOR ART)
FIG. 1 is a cross sectional view showing a conventional switch assembly.
Figure 2:
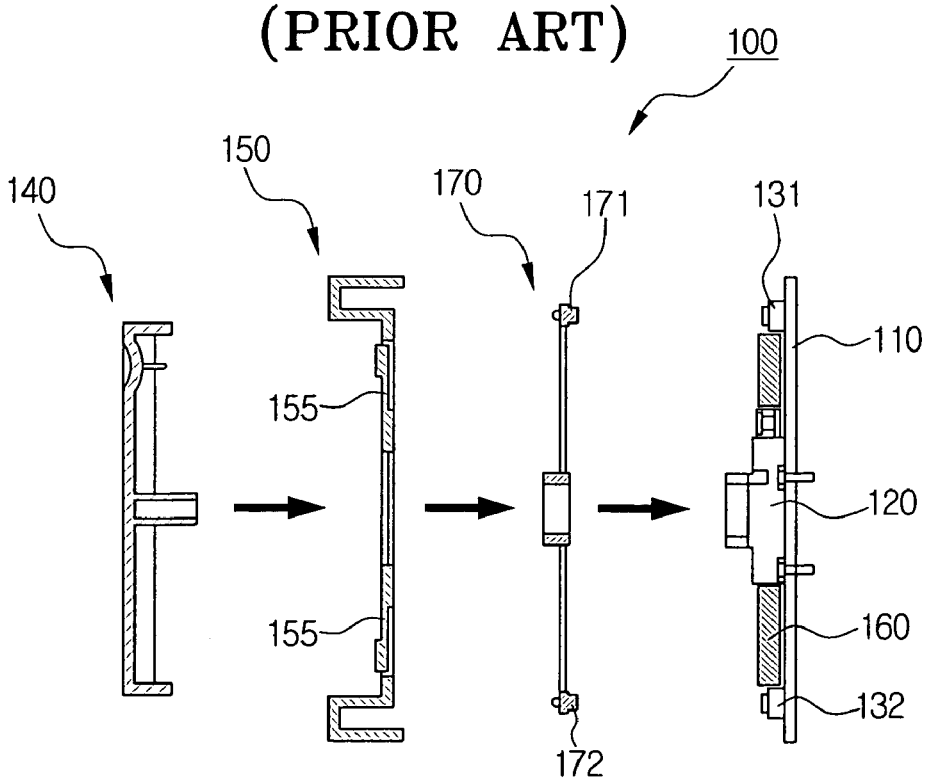
FIG. 2 (PRIOR ART)
FIG. 2 is an exploded view of FIG. 1.
Figure 3:
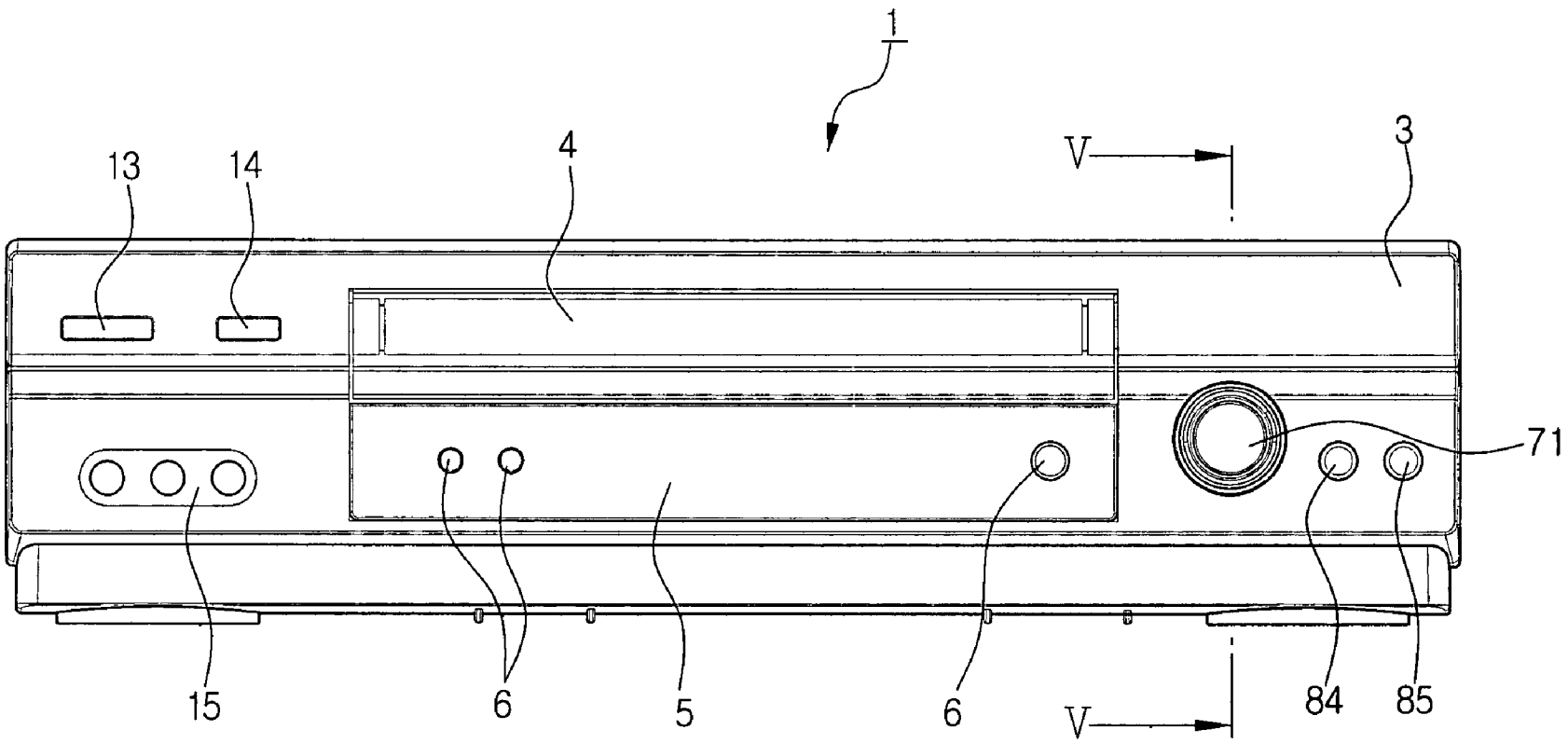
FIG. 3 is a front view showing an electronic product on which a switch assembly is mounted according to an exemplary embodiment the present invention.
Figure 4:
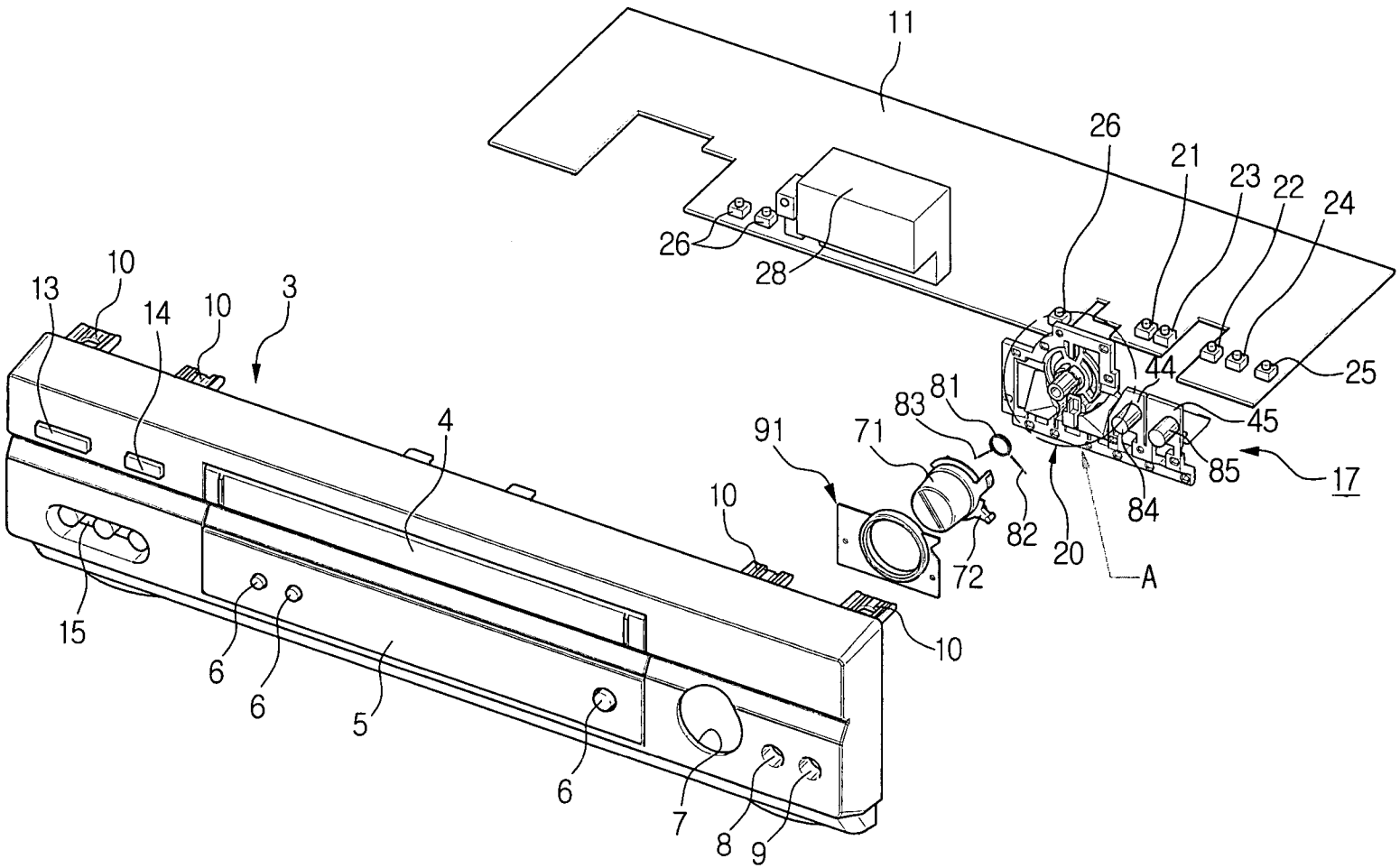
FIG. 4 is a partially exploded perspective view of FIG. 3, in which the construction of the switch assembly is more specifically illustrated.
Figure 5:
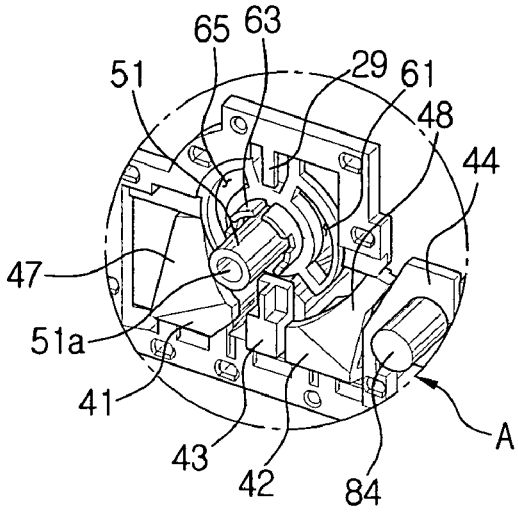
FIG. 5 is an enlarged view of part 'A' of FIG. 4.
Figure 6:
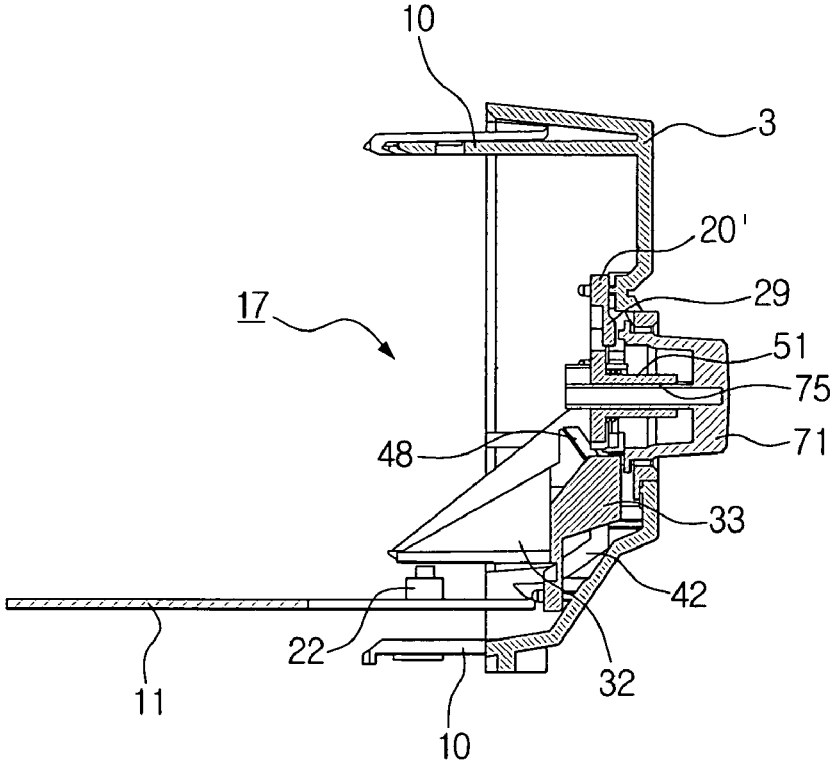
FIG. 6 is a partial cross sectional view of FIG. 3 taken along line V-V.

FIG. 3 is a front view showing an electronic product having a switch assembly mounted therein according to an embodiment of the present invention, FIG. 4 is a partially exploded perspective view of FIG. 3, FIG. 5 is an enlarged view of the part 'A' of FIG. 4, and FIG. 6 is a partial cross section view taken along the line V-V of FIG. 3. As shown in these drawings, an electronic product 1 includes a case body (not shown) having an opening formed in a front portion thereof, and a front panel 3 blocking the opening of the case body. The case body has embedded a plurality of parts and a printed circuit board (PCB) 11. A switching assembly 17, tact switches 21, 22, 23, 24, 25, and 26, and display unit 28 are preferably located on the PCB 11.

As shown in FIG. 3, a door 4 and a display window 5 are located in a center portion of the front panel 3 and located one above the other, and the door 4 vertically pivots to be opened and closed. For example, through the door 4, a medium such as a video tape or a disk is inserted or ejected. The display window 5 is made of a transparent material to expose an operating state displayed on the display unit 28 to the outside. Functions keys 6 protrude through the display window 5 to perform functions of recording, adjusting a channel or adjusting a screen by turning on/off the respective tact switches 26.

The front panel 3 is also provided with a power button 13 and an eject button 14 located on one side of the door 4 and the display window 5. An external input unit 15 having a plurality of external input ports is preferably located under the power button 13 and the eject button 14. Knob holes 7, 8, and 9 are formed in the front panel 3 on the side opposite the power-button 13 and the eject button 14. The knob holes 7, 8, and 9 allow manipulation knobs 71, 84, and 85, which form the switch assembly 17, to protrude through the front panel 3.

As shown in FIG. 4, the front panel 3 has a plurality of connection ribs 10 located at predetermined intervals along the length of the rear edge panel 3. The connection ribs 10 include a connection hole or a hook. If the connection rib 10 has a connection hole, the connection ribs 10 are connected to the case body using an extra connection member (not shown). Meanwhile, if the connection rib 10 has a connection hook, the connection ribs 10 are connected to the case body using a hook hole formed in the case body.

Referring to FIGS. 4 and 5, the switch assembly 17 according to a preferred embodiment of the present invention includes the plurality of tact switches 21, 22, 23, 24, 25, and 26 disposed on the PCB 11, a shuttle body 20 to be mounted on the front panel 3, and the manipulation knob 71 movably connected to the shuttle body 20 for shuttle rotation. It is preferred that the switch assembly 17 further includes a spring member 81 for returning the manipulation knob 71 to an original position.

The tact switches 21, 22, 23, 24, 25, and 26 disposed on the PCB 11 individually perform separate functions. For example, if the first and the second tact switches 21 and 22 are designed to perform the fast-forwarding and rewinding functions, the third switch 23 may be located between the first and the second tact switches 21 and 22 to perform another predetermined function. Also, the fourth and fifth tact switches 24 and 25 are located outside of the second tact switch 22 to perform functions such as pausing and stopping.

Figure 7:
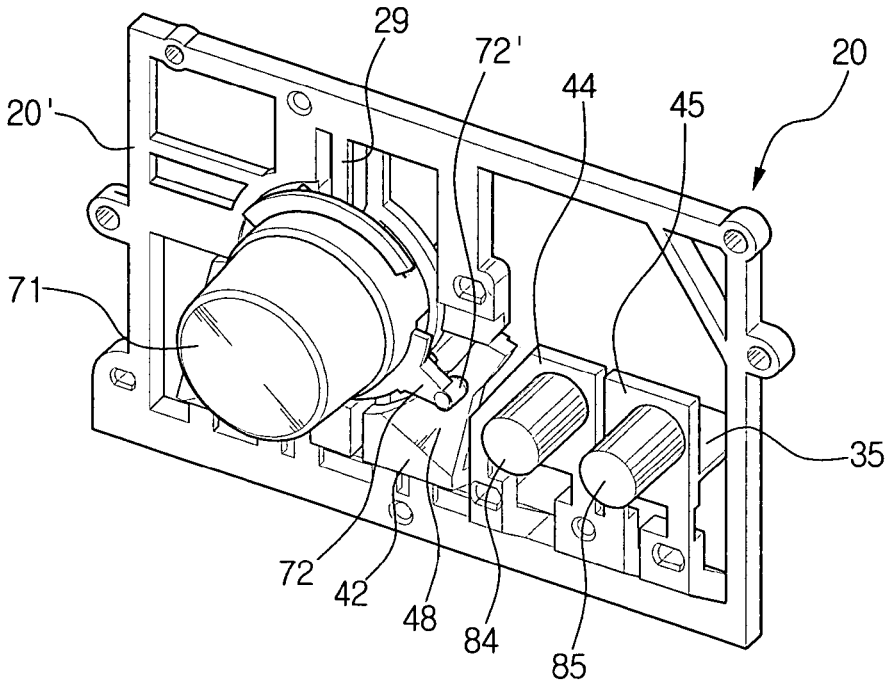
FIG. 7 is a view of FIG. 4 in an assembled state, in which the manipulation knob is connected to the shuttle body.
Figure 8:
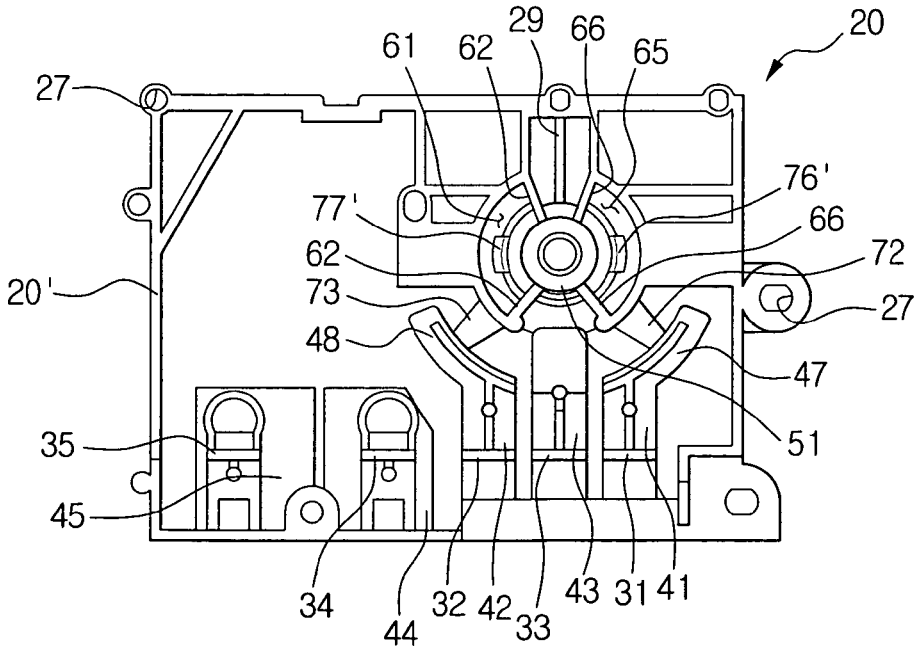
FIG. 8 is a rear elevation view of FIG. 7.
Figure 9:
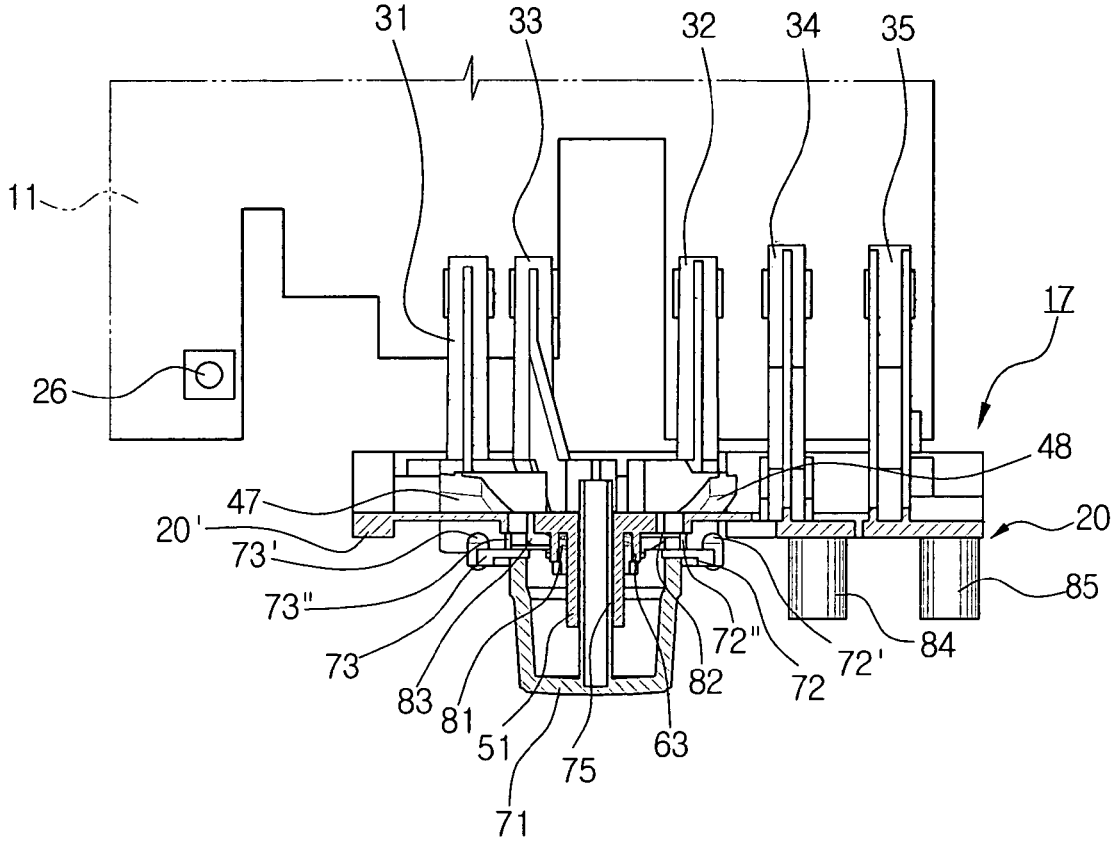
FIG. 9 is a plan view of FIG. 8, which shows the tact switches and the tension ribs located on the PCB.

FIG. 7 is a view showing the switch assembly 17 of FIG. 4 in an assembled state, FIG. 8 is a rear elevation view of FIG. 7, and FIG. 9 is a plan cross sectional view of FIG. 8, which shows the main parts of an exemplary embodiment of the present invention more specifically. Referring to FIGS. 7 and 8, the shuttle body 20 includes a frame 20' fixed to the front panel 3 (not shown), and a first and a second tension ribs 31 and 32 operating with the first and the second tact switches 21 and 22 (not shown), and a knob holding shaft 51 connected to the manipulation knob 71.

The first and the second tension ribs 31 and 32 extend from a lower portion of the frame 20' toward the first and the second tact switches 21 and 22 (not shown) in parallel to each other. The first and the second tension ribs 31 and 32 are elastically deformable in a vertical direction with respect to the frame 20'. As the first and the second tension ribs 31 and 32 are elastically deformed to a lower portion, they turn on/off the corresponding first and the second tact switches 21 and 22 (not shown).

In FIG. 8, the first and the second tension ribs 31 and 32 respectively include protrusions 41 and 42 upwardly protruding from the connected portions to the frame 20', and inclined portions 47 and 48 formed at the ends of the protrusions 41 and 42. The inclined portions 47 and 48 are shaped in arc pattern with respect to the knob holding shaft 51, and maintained at a predetermined angle with respect to the corresponding protrusions 41 and 42. The inclined portion 47 and 48 are pressed and released by an operating portion 72 of the manipulation knob 71, which will be described in greater detail below, thereby being elastically deformed in a forward or a backward direction. Accordingly, the first and the second tension ribs 31 and 32 are elastically deformed in unison with the inclined portions 47 and 48.

Meanwhile, between the first and the second tension ribs 31 and 32 is provided a third tension rib 33 extending toward the third tact switch 23 (not shown). Like the first and the second tension ribs 31 and 32, the third tension rib 33 has a protrusion 43 upwardly protruding to operate with the manipulation knob 71. The protrusion 43 is elastically deformed backward when being pressed at the front portion and in association with this, the third tension rib 33 is elastically deformed to turn on/off the third tact switch 23.

Fourth and fifth tension ribs 34 and 35 operating with the fourth and the fifth tact switches 24 and 25 (not shown) may be located outside the second tension rib 32. Like the first to the third tension ribs 31, 32, and 33, the fourth and the fifth tension ribs 34 and 35 have protrusions 44 and 45 upwardly protruding. The manipulation knobs 84 and 85 (shown in FIG. 7) are connected to the protrusions 44 and 45 of the fourth and the fifth tension ribs 34 and 35 to be exposed to the outside through the knob holes 8 and 9 formed in the front panel 3. When the manipulation knobs 84 and 85 are pressed backward, the fourth and the fifth tension ribs 34 and 35 are elastically deformed in unison with the protrusions 44 and 45, thereby turning on/off the corresponding tact switches 24 and 25 (not shown).

Meanwhile, the knob holding shaft 51 is located in the center above the first and the second tension ribs 31 and 32. The knob holding shaft 51 extends from a plate surface of the shuttle body 20 in a forward direction, and has a shaft hole 51*a* formed in a center thereof. Also, guide recesses 61 and 65, each forming a pattern of a partial arc, are located around the knob holding shaft 51 opposite to each other. The ends of each guide recess 61 and 65 prevent excessive normal/reverse rotations of the manipulation knob 71.

Referring now to FIG. 9, a boss 63 protruding in an arc pattern is located between the knob holding shaft 51 and the guide recesses 61 and 65 (shown in FIG. 8). A spring recess for housing a spring member 81 is formed between the boss 63 and the knob holding shaft 51. The spring member 81 may be a torsion spring. The boss 63 has a predetermined cutting part formed on a lower portion of the boss 63 to hold opposite ends 82 and 83 of the spring member 81 downward. The opposite ends of the spring member 81 held by the cutting part are elastically deformed only in a compressed direction.

Preferably, the shuttle body 20 with the above construction is integrally formed by injection molding. Referring back to FIG. 8, the first and the second tension ribs 31 and 32 may take various forms that are capable of directly operating with the operating portions 72 and 73 of the manipulation knob 71 without the protrusion 41 and 42 and the inclined portions 47 and 48. For example, in order to be operated by the operating portions 72 and 73 of the manipulation knob 71, the first and the second tension ribs 31 and 32 each have an inclined surface formed along the length of their front surface.

Figure 10:
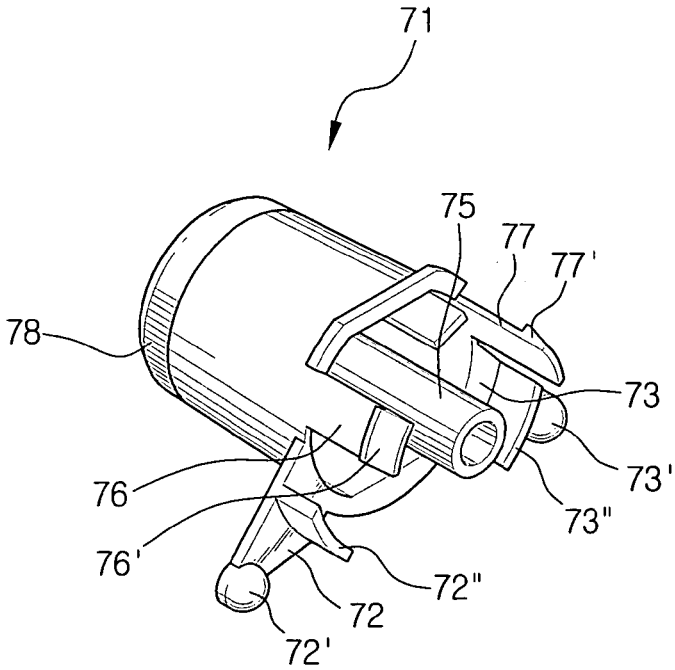
FIG. 10 is a rear elevation perspective view showing the manipulation knob.

Meanwhile, FIG. 10 is a rear elevation view showing the manipulation knob 71. As shown in FIG. 10, the manipulation knob 71 includes a rotary shaft 75 connected to the shaft hole 51*a* of the knob holding shaft 51, the operating portions 72 and 73 operating with the first and the second tension ribs 31 and 32, and connecting portions 76 and 77 movably received in the guide recesses (holes) 61 and 65. The rotary shaft 75 protrudes toward the shuttle body 20 (not shown) along a center axis of the manipulation knob 71 to be rotatably connected to the shaft hole 51*a* of the knob holding shaft 51 (as shown in FIG. 5). The manipulation knob 71 is rotatably connected to the knob holding shaft 51 and is partially exposed to the outside of the front panel 3. A knurling 78 is preferably formed around the circumference on the outer surface of the manipulation knob 71 for the user to grip.

The connection portions 76 and 77 are provided in pairs and extend from the rear end of the manipulation knob 71 toward the shuttle body 20, and have hooks 76' and 77' protruding outward from the ends of the connection portions 76 and 77, respectively. The connection portions 76 and 77 are received in the guide recesses or holes 61 and 65 of the shuttle body 20 to shuttle-rotate along the length of the guide recesses or holes 61 and 65. The hooks 76' and 77' are formed at the end of connection portions 76 and 77 are hooked into the guide holes or recesses 61 and 65 to prevent the manipulation knob 71 from being turned further than the length of the guide recesses or holes 61 and 65.

The operating portions 72 and 73 are provided in pairs and protrude outward from the outer surface of the manipulation knob 71 in a radial direction. Operating portion 72 is a predetermined distance from operating portion 73; the predetermined distance corresponding to the angle between the opposite ends 82 and 83 of the spring member 81. Also, the operating portions 72 and 73 have contact protrusions 72' and 73' formed at their ends to contact the inclined portions 47 and 48 of the first and the second tension ribs 31 and 32. Referring to FIGS. 7 and 8, the first and the second tension ribs 31 and 32 shuttle-rotate in the normal/reverse directions, the contact protrusions 72' and 73' move in unison with the inclined portions 47 and 48 of the first and second tension ribs 31 and 32. As the contact protrusions 72' and 73' move along the inclined portions 47 and 48 in the normal/reverse directions, they press or release the first and the second tension ribs 31 and 32, thereby turning on/off the corresponding tact switches 21 and 22.

Referring now to FIG. 9, the operating portions 72 and 73 have locking protrusions 72" and 73" protruding toward the spring member 81. The locking protrusions 72" and 73" operate with the opposite ends of the spring member 81 received in the spring recess of the shuttle body 20. That is, the opposite ends 82 and 83 of the spring member 81 elastically press the locking protrusions 72" and 73" toward the outside so that the manipulation knob 71 is maintained at a position to press and release the first and the second tension ribs 31 and 32.

In order to assemble a switch assembly 17 having the above construction, first, the spring member 81 is received in the spring recess of the shuttle body 20. Next, the rotary shaft 75 of the manipulation knob 71 is inserted into the shaft hole 51*a* of the knob holding shaft 51 of the shuttle body 20. At this time, it is important that the locking protrusions 72" and 73" of the operating portions 72 and 73 correspond to the opposite ends 82 and 83 of the spring member 81 at the outside. Accordingly, due to the elasticity of the spring member 81, it is possible for the manipulation knob 71 to shuttle-rotate between a position where the manipulation knob 71 releases the first and the second tension ribs 31 and 32 and a position where the manipulation knob 71 presses the first and the second tension ribs 31 and 32.

The shuttle body 20, assembled with the manipulation knob 71, is fixed to the rear surface of the front panel 3. The frame 20' of the shuttle body 20 has a connection recess (reference numeral 27 of FIG. 8) formed along its longitudinal direction into which the shuttle body 20 is fixed. A plurality of connection members (not shown) formed on the rear surface of the front panel 3 are connected to the connection recess so that the shuttle body 20 is fixed to the front panel 3. It is preferred that a shuttle ring (reference numeral 91 of FIG. 4) is located between the front panel 3 and the shuttle body 20. The shuttle ring 91 aids in smooth rotation of the manipulation knob 71, which extends through the knob hole 7 in the normal/reverse directions to the exterior of the front panel 3.

Meanwhile, the tact switches 21, 22, 23, 24, 25, and 26 are fixed onto pre-set positions on the PCB 11. The PCB 11 has tact switches 21, 22, 23, 24, 25, and 26 installed on it and is connected to a predetermined position on the bottom of the case body. Accordingly, as the front panel 3 is assembled with the case body, the first and the second tension ribs 31 and 32 of the shuttle body 20 correspond to the first and the second tact switches 21 and 22 located on the PCB 11.

A user can grip the manipulation knob 71 positioned at a press-release position and shuttle-rotate it in the normal/reverse directions. During the shuttle rotation of the manipulation knob 71, the operating portions 72 and 73 elastically deform the first and the second tension ribs 31 and 32. Then, the first and the second tact switches 21 and 22 are turned on/off to perform the corresponding functions. Thus, when the user ceases applying force to the manipulation knob 71, the spring member 81 returns to the press-release position by the recovering force thereof.

When a user presses the manipulation knob 71 backward, the third tension rib 33 is elastically deformed to turn on/off the third tact switch 23. It is preferable not to elastically deform the third tension rib 33 freely by the manipulation knob 71. In this embodiment, an elastic supporting rib (a reference numeral 29 of FIG. 7) is formed at a position corresponding to the third tension rib 33 with respect to the knob holding shaft 51. The elastic supporting rib 29 presses the manipulation knob 71 forward, thereby preventing the third tension rib 33 from operating freely.

According to embodiments of the present invention as described above, assembling and disassembling of the switch assembly 17 becomes easy and simple because the shuttle body 20 is integrally formed with the knob holding shaft 51 by the injection molding and the tact switches are located on the PCB. Accordingly, manufacturing costs and maintenance costs can be reduced.

Also, the switch assembly 17 with a simple compact construction reduces the overall size of a product and allows the user to manipulate it with ease and convenience.

The foregoing embodiment and advantages are merely exemplary and are not to be construed as limiting the present invention. The description of the present invention is intended to be illustrative, and not to limit the scope of the claims. Many alternatives, modifications, and variations will be apparent to those skilled in the art.

What is claimed is:

1. A switch assembly comprising:

first and second tact switches disposed on a printed circuit board (PCB) at a predetermined interval;

a shuttle body having a pair of tension ribs, including a first tension rib and a second tension rib located parallel to each other, to turn on/off the first and the second tact switches, and a knob holding shaft provided between the first and the second tension ribs;

a manipulation knob connected to the knob holding shaft of the shuttle body, rotating between a position where the manipulation knob presses one of the first and the second tension ribs to operate the corresponding tact switch and a position where the manipulation knob releases the tension rib; and a spring member connected to the knob holding shaft of the shuttle body, elastically pressing the manipulation knob to the releasing position.

2. The switch assembly of claim 1, wherein the manipulation knob comprises:

a pair of operating portions outwardly protruding from the manipulation knob in a radial direction, having a predetermined angle therebetween, and operating the first and the second tension ribs of the shuttle body; and a connection portion extending from the manipulation knob in an axial direction and connected to the shuttle body.

3. The switch assembly of claim 2, wherein the first and the second tension ribs of the shuttle body each comprises:

a protrusion upwardly protruding toward the manipulation knob; and an inclined portion formed at a predetermined inclination angle with respect to the protrusion and inwardly curved, contacting with the operating portion of the manipulation knob.

4. The switch assembly of claim 2, wherein the shuttle body has a guide recess formed therein, to receive the connection portion of the manipulation knob and restrict the movements of the connection portion within a predetermined range.

5. The switch assembly of claim 2, wherein the operating portions of the manipulation knob each includes a pair of locking protrusions locked by opposite ends of the spring member and is exerted with an elastic biasing force toward the releasing position.

6. The switch assembly of claim 1, wherein a third tact switch is further disposed on the PCB, and the shuttle body further includes a third tension rib located between the first and the second tension rib to operate with the third tact switch, and the third tension rib is elastically deformed when being pressed by the manipulation knob positioned at the release position, thereby turning on the third tact switch.

7. The switch assembly of claim 6, wherein the shuttle body is provided with an elastic supporting rib which elastically supports the manipulation knob such that the third tension rib is placed at a position to turn off the third tact switch.

8. The switch assembly of claim 6, further comprising a shuttle ring located between the manipulation knob and a front panel of an electronic product through which a part of the manipulation knob extends to the exterior of the electronic product.

9. The switch assembly of claim 1, further comprising a shuttle ring located between the manipulation knob and a front panel of an electronic product through which a part of the manipulation knob extends to the exterior of the electronic product.

* * * * *

UNITED STATES PATENT AND TRADEMARK OFFICE

CERTIFICATE OF CORRECTION

PATENT NO. : 7,586,054 B2
APPLICATION NO. : 10/899114
DATED : September 8, 2009
INVENTOR(S) : Seong-ki Jin It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1013 days.

Signed and Sealed this

Fourteenth Day of September, 2010

David J. Kappos

David J. Kappos
*Director of the United States Patent and Trademark Office*